US011173701B2

(12) United States Patent
Yraceburu et al.

(10) Patent No.: US 11,173,701 B2
(45) Date of Patent: Nov. 16, 2021

(54) DRYING SPEED ADJUSTMENTS VIA DENSITY INDEX ANALYSIS

(71) Applicant: HEWLETT-PACKARD DEVELOPMENT COMPANY, L.P., Spring, TX (US)

(72) Inventors: Robert Yraceburu, Vancouver, WA (US); Timothy Jacob Luedeman, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/603,829

(22) PCT Filed: Sep. 1, 2017

(86) PCT No.: PCT/US2017/049891
§ 371 (c)(1),
(2) Date: Oct. 8, 2019

(87) PCT Pub. No.: WO2019/045752
PCT Pub. Date: Mar. 7, 2019

(65) Prior Publication Data

US 2020/0180302 A1 Jun. 11, 2020

(51) Int. Cl.
*B41J 11/00* (2006.01)
*B41J 3/60* (2006.01)
*B41F 23/04* (2006.01)

(52) U.S. Cl.
CPC ..... *B41F 23/0443* (2013.01); *B41J 3/60* (2013.01); *B41J 11/002* (2013.01)

(58) Field of Classification Search
CPC ..... B41F 23/0443; B41F 3/60; B41F 11/002; B41F 11/0024; B41F 11/0015; B41F 13/0045; G03G 15/231; G03G 15/2014
See application file for complete search history.

(56) References Cited

U.S. PATENT DOCUMENTS 5,349,905 A * 9/1994 Taylor ..... B41J 11/00216 101/488
5,359,433 A 10/1994 Nagase et al.
(Continued)

FOREIGN PATENT DOCUMENTS

EP 1277588 1/2003
EP 3017958 5/2016

OTHER PUBLICATIONS

Shaleen, How Long Does Photo Printing Ink Take to Dry,Jul. 24, 2015, http://blog.inkjetwholesale.com.au/printer-education/how-long-does-photo-printing-ink-take-to-dry/.

*Primary Examiner* — Scott A Richmond
(74) *Attorney, Agent, or Firm* — HP Inc. Patent Department

(57) ABSTRACT

An example of a print system including a dryer to dry a sheet of paper. The print system includes a media feeder to feed the sheet of paper into the dryer and a controller to vary a speed of the media feeder. The print system includes a communication interface to receive data associated with an image to print on the sheet of paper and a processor. The processor is coupled to the controller and the communication interface. The processor is to determine a first density index for a first portion of the image and to determine a second density index for a second portion of the image. The processor is to adjust the speed of the media feeder via the controller based on the first density index and the second density index.

15 Claims, 7 Drawing Sheets

(56) References Cited

U.S. PATENT DOCUMENTS

| | | | | |
|---|---|---|---|---|
| 5,640,190 | A | 6/1997 | Bollansee et al. | |
| 6,733,110 | B1 | 5/2004 | Pinkernell et al. | |
| 7,014,295 | B2 * | 3/2006 | Hickman | B41J 2/2132 347/41 |
| 7,258,067 | B2 | 8/2007 | Silverbrook | |
| 9,460,375 | B2 | 10/2016 | Bayona et al. | |
| 9,527,311 | B2 | 12/2016 | Hamazaki et al. | |
| 2007/0019050 | A1 | 1/2007 | Lim | |
| 2011/0267396 | A1 * | 11/2011 | Yamamoto | B41J 11/0022 347/16 |
| 2014/0022295 | A1 * | 1/2014 | Metcalfe | B41J 25/001 347/14 |
| 2014/0354728 | A1 | 12/2014 | Murata et al. | |

* cited by examiner

300

| | | | | | | |
|---|---|---|---|---|---|---|
| 32 | 25 | 17 | 10 | 17 | 25 | 32 |
| 17 | 13 | 9 | 7 | 9 | 13 | 17 |
| 10 | 7 | 6 | 5 | 6 | 7 | 10 |
| 8 | 5 | 4 | 4 | 4 | 5 | 8 |
| 6 | 3 | 2 | 2 | 2 | 3 | 6 |
| 5 | 3 | 2 | 1 | 2 | 3 | 5 |
| 6 | 3 | 2 | 2 | 2 | 3 | 6 |
| 8 | 5 | 4 | 4 | 4 | 5 | 8 |
| 10 | 7 | 6 | 5 | 6 | 7 | 10 |
| 17 | 13 | 9 | 7 | 9 | 13 | 17 |
| 32 | 25 | 17 | 10 | 17 | 25 | 32 |

FIG. 5

680

605

620

| | | | | | | |
|---|---|---|---|---|---|---|
| 32 | 25 | 17 | 10 | 17 | 25 | 32 |
| 30 | 21 | 18 | 15 | 18 | 21 | 30 |
| 51 | 39 | 27 | 21 | 27 | 39 | 51 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 0 | 0 | 0 | 0 | 0 | 0 | 0 |
| 51 | 39 | 27 | 21 | 27 | 39 | 51 |
| 30 | 21 | 18 | 15 | 18 | 21 | 30 |
| 0 | 0 | 0 | 0 | 0 | 0 | 0 |

FIG. 7

DRYING SPEED ADJUSTMENTS VIA DENSITY INDEX ANALYSIS

BACKGROUND

Imaging devices, such as printers, generally include a print path where printing operations are performed. For example, a print path may be a space through the imaging device in which media passes to different areas of the print system to perform an imaging operation. For another example, a print system may take paper from a paper tray, move it to the print zone to print ink onto the paper, to a drying zone to dry the ink, and then move the paper to an output stack.

BRIEF DESCRIPTION OF THE DRAWINGS

Reference will now be made, by way of example only, to the accompanying drawings in which:

FIG. 5 is an example of a weighted matrix;

FIG. 7 is an example of a matrix of density scores.

DETAILED DESCRIPTION

Figure 1:
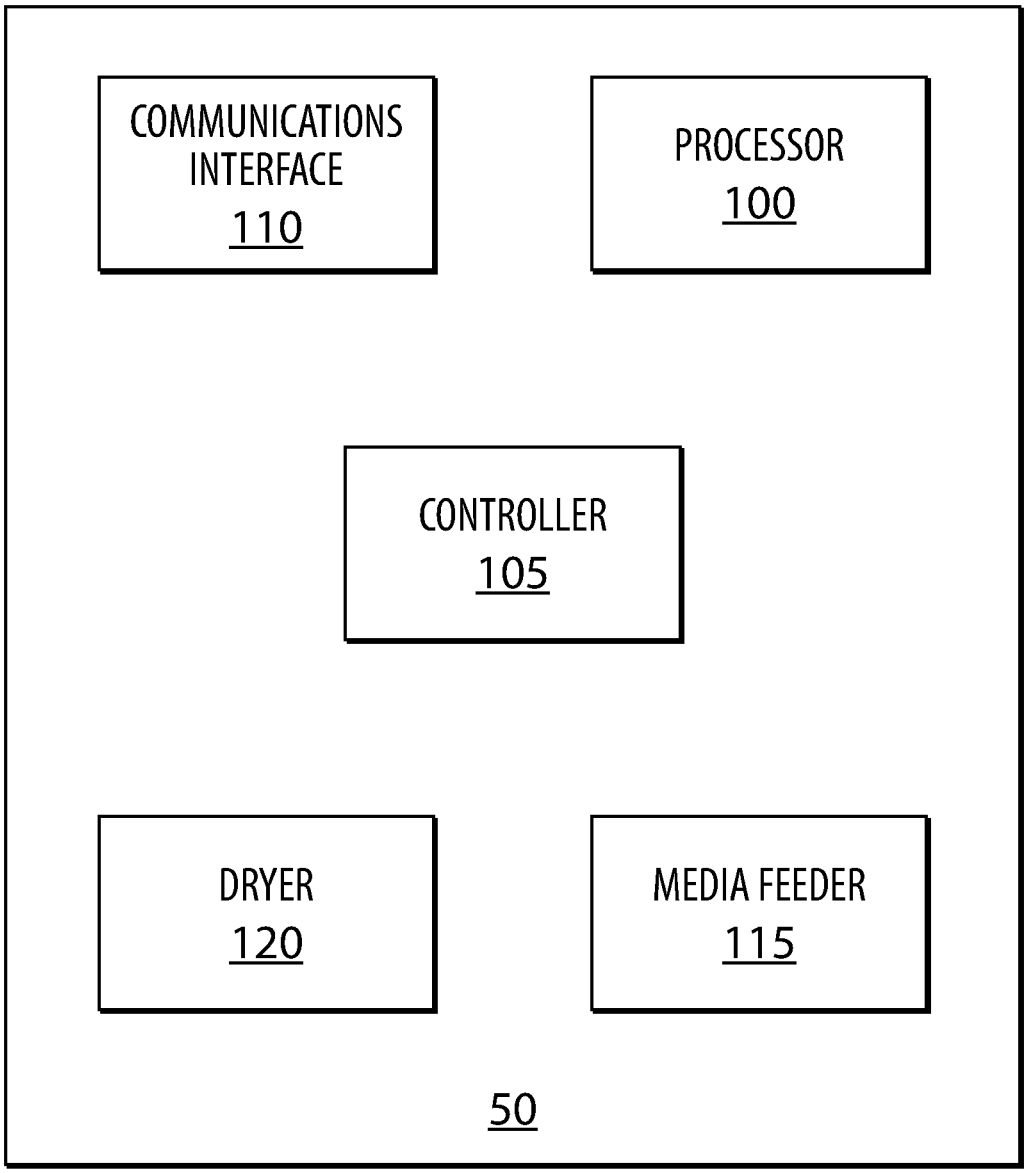
FIG. 1 is a block diagram of an example print system.

In the following description and figures, some example implementations of imaging apparatus, print systems, and/or methods for adjusting operation of an imaging device are described. An imaging apparatus may be a print system that performs printing operations. In examples described herein, a system may be a device or a plurality of devices to print content on a physical medium, such as paper or a layer of powder-based build material, etc., with a print fluid, such as ink or toner. In the case of printing on a layer of powder-based build material, the print device may utilize the deposition of print fluids in a layer-wise additive manufacturing process. The print device may utilize suitable printing consumables, such as ink, toner, fluids or powders, or other raw materials for printing. An example of print fluid is a substance ejectable from a print head, such as ink, toner, gloss enhancer, a reflective enhancer, fluorescing agents, and the like. In some examples, a printing device may be a three-dimensional printing device and a print fluid may be a powder-based build material, a fusing agent, a coloring agent, and the like.

Wetting media with large quantities of aqueous ink may cause the media to deform, swell, distort, buckle, and/or curl. Thus, media that is wet with a particular degree of printing fluid may not move along the print path in the same way as media wet with a different degree of printing fluid density, such as a blank page with no printing fluid compared to a photograph covering the entire media. This may ultimately lead to paper jams, damaged paper, poor print quality, print head health issues, and user dissatisfaction. The effect of the print fluid on the state of the media may be influenced by the location of the print fluid on the printing plane. As used herein, the printing plane may refer to the plane on which a medium exists or, in the context of 3D printing, the plane on which a layer of build material is printed.

Various examples described below relate to adjusting operations of a print system based on the print density of print fluid placed on a plane during execution of a print job. For example, a component of the print system, such as the drying mechanism, may be adjusted differently for a first location of the print fluid on the plane than for a second location of the print fluid on the plane. This may be due to a relative effect of distortion of the media in sensitive areas of the media, such as a corner, for example. Such distortions may be a factor that generates operational issues, such as skew or a paper jam, for example. The media control issues may be compensated for by identifying print fluid density. A determination of the location of the possible distortion and print fluid density at the location can provide proper adjustments in an individualized way. For example, dense ink printed in the center of the page may not need as slow of a speed of the page along the print path as dense ink printed on the edge and/or corners of the page. By dividing the plane into regions, the relationship of print fluid density between regions may be used, as described herein, to dynamically compensate or otherwise assist operation of the print device, such as assist determination of proper movement and speed of a page along the print path.

Referring to FIG. 1, a print system is generally shown at 50. The print system 50 is to generate images on print media. In the present example, the print system is an ink jet printer to print on sheets of paper. However, in other examples, the print system 50 may be any one of the above mentioned print systems. In the present example, the print system 50 includes a processor 100, a controller 105, a communications interface 110, a media feeder 115, and a dryer 120.

The communications interface 110 may be coupled to the processor 100 and allows the processor 100 to receive data associated with an image to print onto media, such as a sheet of paper. In the present example, the communications interface 110 communicates with a network, such as the Internet or a local network, and receives data via the network. The network provides a link to another device, such as a content provider, a personal computer, a mobile computing device, or any other device from which an image may be provided. The communications interface 110 may also include a universal serial bus (USB) port, a serial port, a parallel port, a wired network adaptor, a wireless network adaptor, or similar.

The controller 105 is coupled to the processor 100 and includes any circuitry or combination of circuitry and executable instructions to control the media feeder 115, or cause an adjustment of an attribute of the media feeder 115. In the present example, the controller 105 is to control and vary the speed of the media, such as a sheet of paper, along the path of the media feeder 115. In particular, the controlled speed at which the sheet of paper moves through the media feeder 115 determines the speed at which the sheet of paper will pass through other components of the print system 50, such as the dryer 120. The controller 105 may also control other attributes of the media feeder 115, such as the direction or the path of the sheet of paper.

The media feeder 115 is controlled by the controller 105 and is to move media through the print system 50. In the present example, the media feeder 115 may include, for example, a variety of guides, rollers, wheels, motors, etc. for handling and/or routing of print media through the printing system 50, including transporting, guiding, and/or directing the media to a print zone, and/or transporting, guiding, and/or directing the media to the dryer 120 as well as through the dryer 120 from print zone, and the controller 105 may be used to adjust the variety of guides, rollers, wheels, and motors.

The dryer 120 is to dry the media, such as a sheet of paper, after an application of print fluid. In the present example, the dryer 120 provides heat and/or air flow to the sheet of paper. In the present example, the manner by which the dryer 120 provides heat is constant. Accordingly, adjustment of the drying process is carried out by adjusting the period of time the sheet of paper is placed in the dryer 120. In other examples, the dryer 120 may have an adjustable temperature, position, and/or an air speed, which may be controlled by the controller 105.

The processor 100 may include a central processing unit (CPU), a microcontroller, a microprocessor, a processing core, a field-programmable gate array (FPGA), or similar. The processor is coupled to the controller 105 and the communications interface 110. The processor 100 executes instructions to control the print system 50 in general.

In addition, the processor 100 is to analyze the data received from the communication interface 110 to determine a first density index associated with a first portion of the image and a second density index associated with a second portion of the image. The density indices may then be used to calculate target drying parameters for portions of the image. Accordingly, the processor 100 may send signals to the controller 105 to change the drying conditions as the sheet of paper passes through the dryer 120. In the present example, since the dryer 120 heats under constant conditions, the speed at which the sheet of paper passes through the dryer 120 may be varied by controlling the media feeder 115 via the controller 105. For example, for portions of the sheet of paper requiring additional drying due to higher density of print fluid, the media feeder 115 may slow the sheet of paper along the print path such that the sheet of paper remains inside the dryer 120 for a longer period of time. Alternatively, for portions of the sheet of paper requiring less drying due to lower density of print fluid (or absence of print fluid), the media feeder 115 may increase the speed of the sheet of paper along the print path such that the sheet of paper remains inside the dryer 120 for a shorter period of time.

In the present example, the density index may be used to determine the speed at which the paper is moved through the print system 50 by the media feeder 115. The speed may be determined using a lookup table where a density index corresponds with a specific speed.

Figure 2:
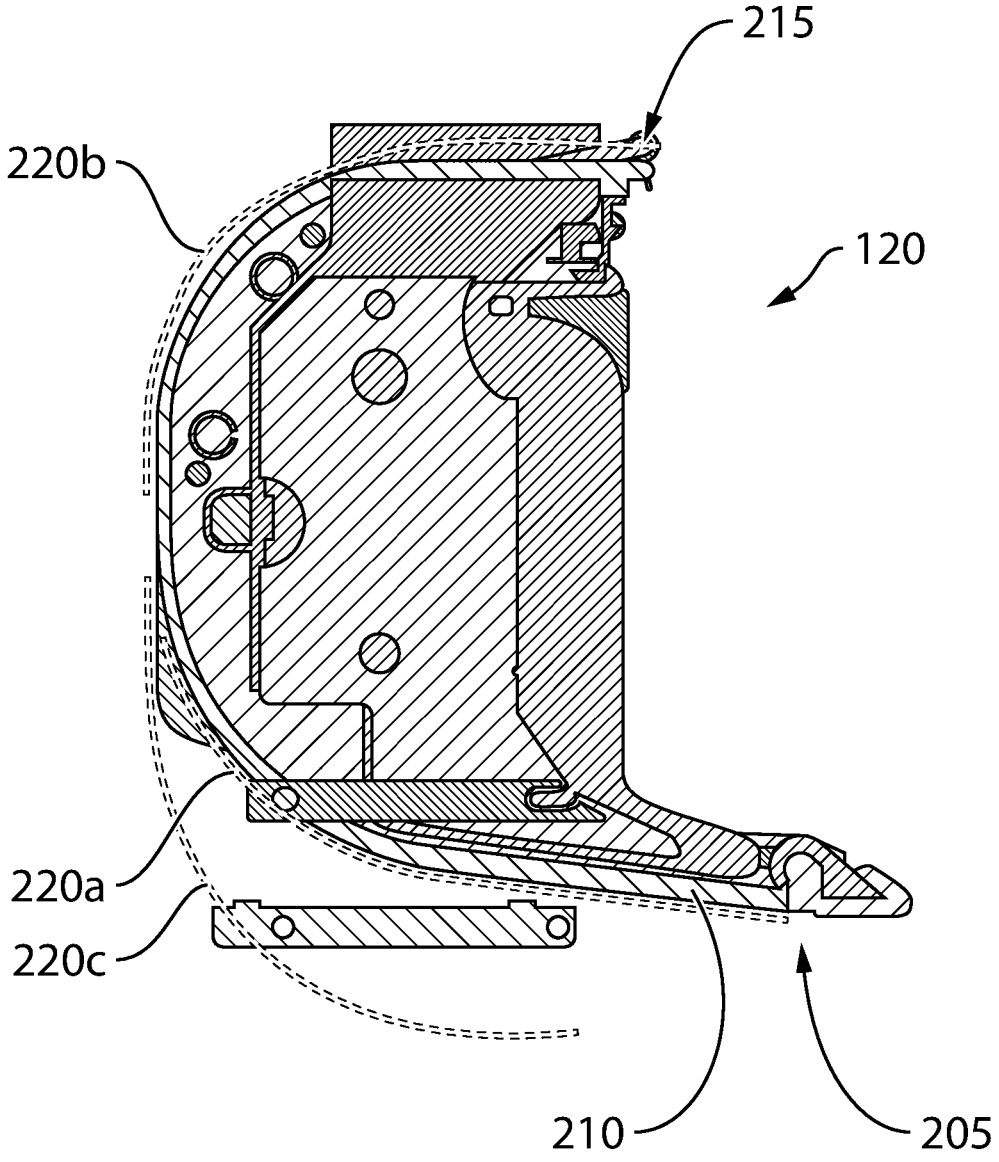
FIG. 2 is an example of a dryer.

Referring to FIG. 2, the dryer 120 is shown in greater detail. In the present example, the dryer 120 includes an entry point 205, a heating portion 210 that extends the length of the dryer and an exit point 215. The dryer 120 receives a sheet of paper via the entry point 205. As shown in FIG. 2, the sheet of paper passes through position 220*a* when heated by the heating portion 210. The sheet of paper proceeds to position 220*b* and then through the exit point 215 into an output tray (not shown) when only one side of the sheet of paper is to be printed. In other examples, where the print system 50 is used to provide duplex printouts, the sheet of paper does not exit through the exit point 215 after a first pass through the dryer 120. Instead, the sheet of paper reverses direction and travels back along a different path to position 220*c* from where the sheet of paper exits the dryer 120 to a duplexer (not shown) to print on the second side of the sheet of paper.

Figure 3:
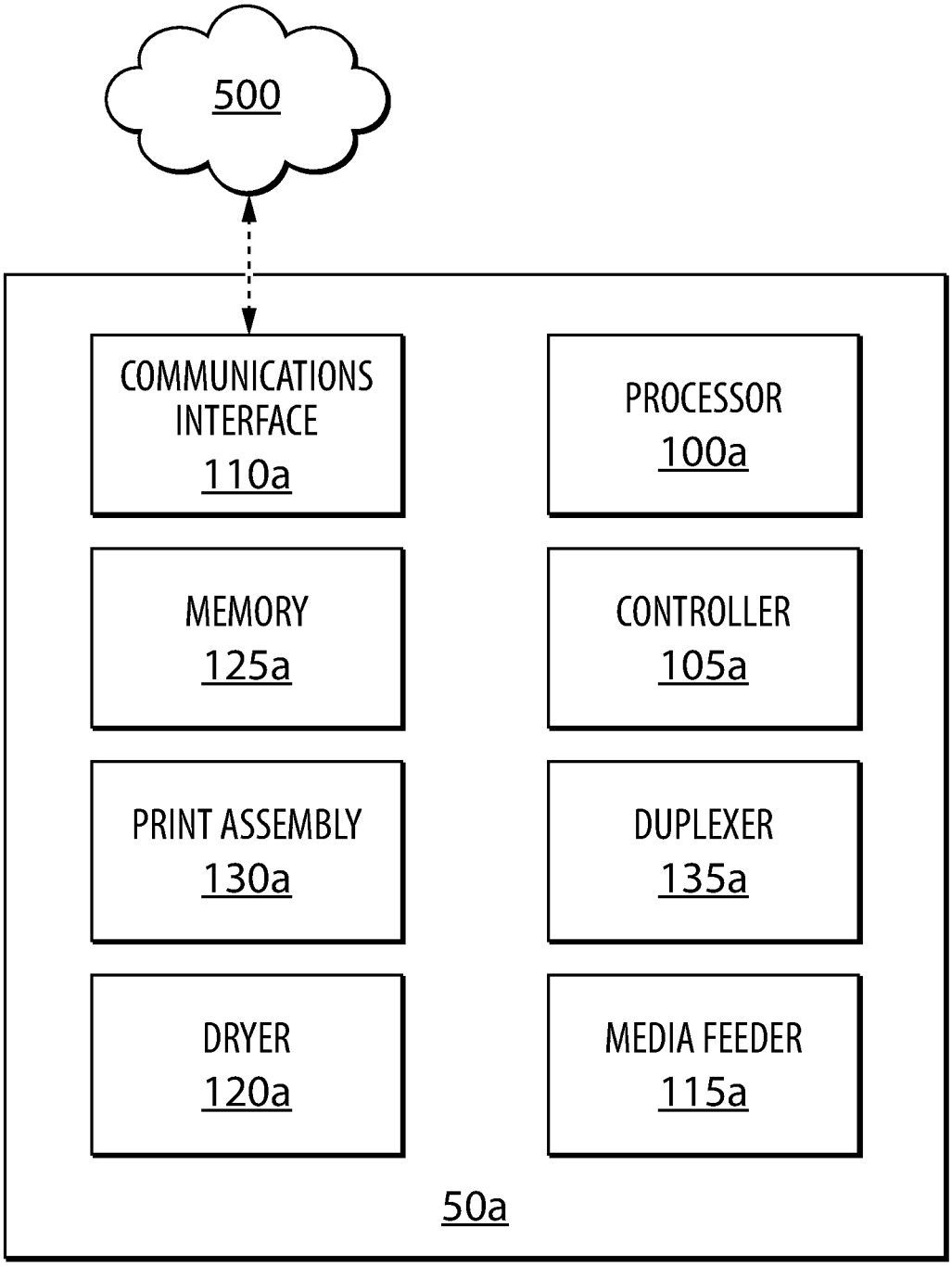
FIG. 3 is a block diagram of another example print system.

Referring to FIG. 3, another print system is generally shown at 50*a*. The print system 50*a* is to generate images on print media. Like components of the print system 50*a* bear like reference to their counterparts in the print system 50, except followed by the suffix "a". In the present example, the print system 50*a* includes a processor 100*a*, a controller 105*a*, a communications interface 110*a*, a media feeder 115*a*, a dryer 120*a*, a memory 125*a*, a print assembly 130*a* and a duplexer 135*a*.

In the present example, the communications interface 110*a* may be coupled to the processor 100*a* and allows the processor 100*a* to receive data associated with an image to print onto media, such as a sheet of paper. In the present example, the communications interface 110*a* communicates with a network 500.

The controller 105*a* is coupled to the processor 100*a* and includes any circuitry or combination of circuitry and executable instructions to control components of the print system 50*a*. For example, the controller 105*a* may be used to control the print assembly 130*a* to dispense print fluid onto the media, such as a sheet of paper.

The memory 125*a* is coupled to the processor 100*a* and may include a non-transitory machine-readable storage medium that may be any electronic, magnetic, optical, or other physical storage device. In the present example, the memory 125*a* may store images to print, such as a print queue. The memory 125*a* may also store executable instructions. For example, the memory 125*a* may include instructions to receive data associated with images to print via the communications interface 110*a*. The memory 125*a* may include instructions to apply a mask or supermask to the image data to separate the image into multiple portions as well as to determine density indices within the portions of the image. In addition, the memory 125*a* may include instructions to operate the controller 105*a*, such as to adjust a speed of the media feeder 115*a*.

The non-transitory machine-readable storage medium may include, for example, random access memory (RAM), electrically-erasable programmable read-only memory (EEPROM), flash memory, a storage drive, an optical disc, and the like. The memory 125*a* may also store an operating system that is executable by the processor 100*a* to provide general functionality to the print system 50*a*, including functionality to support applications on the print system. Examples of operating systems include Windows™, macOS™, iOS™' Android™, Linux™, and Unix™. The memory 125*a* may additionally store applications that are executable by the processor 100*a* to provide specific functionality to the print system 50*a*, such as functionality to copy, scan, and fax document.

The print assembly 130*a* is not particularly limited and may include any assembly to generate an image on a sheet of paper. For example, the print assembly 130*a* may include a print head or fluid ejection device which ejects drops of print fluid through a plurality of orifices or nozzles onto the sheet of paper. In an example, a print fluid supply may include a reservoir for storing print fluid and supply printing fluid to a print head, and the controller 105*a* may adjust fluid flow from the reservoir to the print head based the data associated with the image. As another example, a print assembly 130 may include a print bar and the controller 105*a* may adjust a temperature of the print bar (or other input energy variable) to generate the image.

The duplexer 135*a* is not particularly limited and includes any mechanism to provide print on both sides of a sheet of paper. In the present embodiment, the duplexer 135*a* includes a plurality of rollers and media guides to turn the sheet of paper over such that the sheet of paper re-enters a print area with the other side facing the print assembly 130*a*. However, in other embodiments, the duplexer 135*a* can be any device capable of receiving a sheet of paper with a top side up and outputting the sheet of paper with the top side down.

Figure 4:
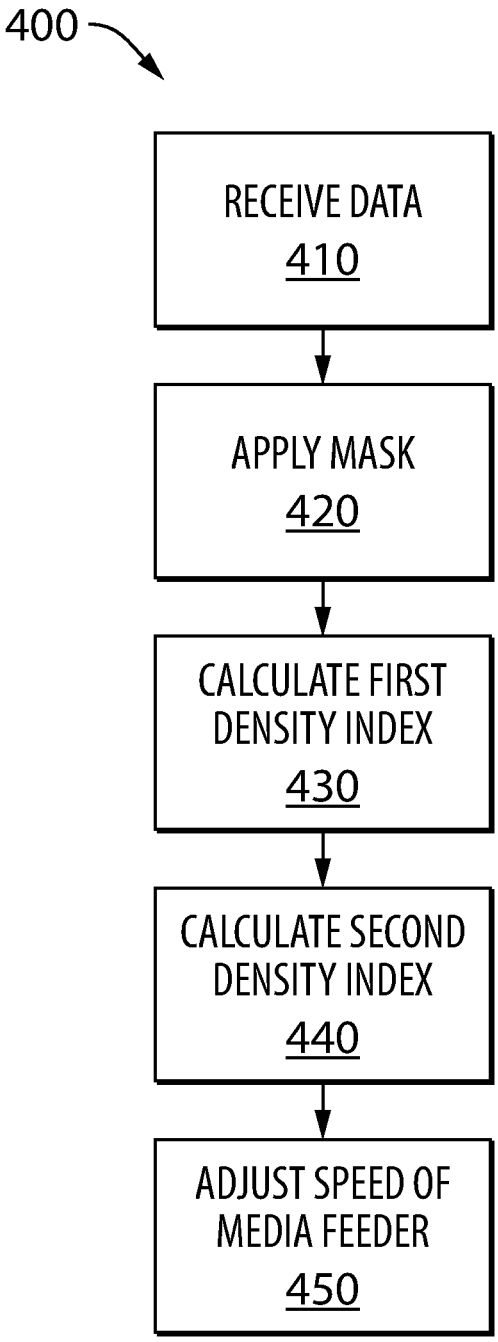
FIG. 4 is a flowchart of an example method.

Referring to FIG. 4, a flowchart of a method of drying a printed document is shown at 400. In order to assist in the explanation of method 400, it will be assumed that method 400 may be performed with the print system 50 or 50*a*, and specifically by the processor 100 or 100*a*. Indeed, the method 400 may be one way in which print systems 50 and 50*a* may be configured. Furthermore, the following discussion of method 400 may lead to a further understanding of the processor 100 and 100*a*, and the print systems 50 and 50*a* along with their various components.

Beginning at block 410, data associated with an image to be printed on a sheet of paper is received via the communications interface 110. The manner by which the data is generated is not particularly limited. For example, the data may be received from an external device such as a computing device to print a document. As another example, the data may be generated by an input device on the print system 50*a*, such as a scanner (not shown) to copy a document.

Next, at block 420, the processor applies a mask to the image to be printed. The mask is generally used to separate the image into multiple portions. In the present example, the mask includes two regions, a leading edge and a trailing edge. The leading edge is the first half of the sheet of paper to enter the dryer 120*a*. The mask applies a correction factor to the leading edge and the trailing edge to account for different amounts of time spent in the dryer 120*a*, such as during duplex printing. The manner by which the correction is applied is not limited and may include the reduction of a density score by a predetermined percentage, subtraction of a fixed amount from the density score, or a combination. In particular, when the paper reaches position 220*b* prior to changing direction, the leading edge of the paper may have been in contact with the heating portion 210 for longer time than the trailing edge. This may result in over drying of the leading edge. Additionally, the leading edge portion of the mask may factor this in to reduce the amount of time the sheet of paper is in contact with the heating portion 210 to obtain a similar effect.

Block 430 calculates a first density index associated with the first portion (i.e. the leading edge) of the image. To calculate the first density index, the mask is applied to a density score for the first portion. The manner by which the density scores are calculated is not particularly limited. For example, the density score determined based on the ink density applied to the leading edge. In another example, a weighted matrix with a plurality of cells may be applied to the image to determine a density score by consideration of the effects of the location of the ink loading. In this example, the weighted matrix may be populated with predetermined values associated with the properties of a media, such as the type and thickness of the paper. In other examples, the media may be detected and values determined based on other factors.

To load ink near the edges of a sheet of paper may have more effect on the deformation of the paper than to load the same amount of ink onto the center of the sheet of paper. To divide the sheet of paper into cells, the positional effect may be accounted for by empirically determined values for each cell. The score for each cell may be calculated based on the ink density within that cell and the weight assigned to the cell. Accordingly, the density score for a portion of the image may then be generated by addition of the scores of each cell in the portion of the image. After a density score is determined, the first density index may be determined by application of the mask for that portion of the image, such as the leading edge or the trailing edge. In the present example, since the mask includes a correction factor for the leading edge, the density index is reduced to account for the additional time the leading edge is in contact with the heating portion 210.

The manner by which the ink density is determined is not particularly limited. In the present example, the ink density may be determined based on the data of the image received at block 410. In particular, the data may include the amount of ink to deposit onto the paper for each pixel. Accordingly, the ink density for a cell may be determined by calculation of the sum the ink deposited for all pixels within the cell. In the present example, the size of the pixel can be varied. By decreasing the pixel size (i.e. having a larger number of pixels on the sheet of paper), the accuracy of the density score can be improved when applying a weighted matrix, as discussed in more detail below. By increasing the pixel size (i.e. having a lower number of pixels on the sheet of paper) or not dividing a portion onto pixels, the accuracy of the density score will decrease, but the demand on computational resources will decrease resulting in faster printing by the print system 50.

Block 440 calculates a second density index associated with the second portion (i.e. the trailing edge) of the image. The manner by which the second density index is calculated is limited and may include any of the methods discussed above in connection with block 430.

Block 450 adjusts the speed of the media feeder 115 or 115*a*. In the present example, the processor 100 or 100*a* sends a signal to the controller 105 or 105*a* to adjust the speed of the sheet of paper in the dryer 120 or 120*a* based on the first density index and the second density index. In particular, the paper speed may be increased or decrease through the dryer 120 or 120*a*. In the present example, there are two portions of the image and the reference point may be set to be when the portion first enters the dryer at the entry point 205. Accordingly, as the sheet of paper enters the dryer 120, the speed may be based on the density index of the leading edge. Once the beginning of trailing edge reaches the entry point 205, the speed of the paper is increased or decreased based on the density index of the trailing edge. For example, under the assumption of a uniform weighted matrix and an image of uniform ink density, the leading edge may have a lower density score based on the correction factor. Accordingly, the lower density score may indicate less drying is necessary and that the paper should spend less time in the dryer 120. Accordingly, the speed of the paper to enter the dryer at the entry point 205 may be at a fast speed. The density index of the trailing edge may be higher than the density index of the leading edge. Accordingly, once the trailing edge enters the dryer 120, the controller 105 may slow the paper in the dryer to increase the drying time of the trailing edge relative to the drying time of the leading edge.

Variations to the above method are contemplated. For example, although only two portions, a leading edge and a trailing edge are discussed, more portions may be defined with the mask. When more portions are defined, further refinement of the drying conditions is achieved; however, more computational resources may need to be used to determine the density index for each portion and control the media feeder 115 or 115*a* accordingly.

Referring to FIG. 5, an example of a weighted matrix is shown at 300. The matrix 300 may be applied to an image on a sheet of paper or other media. In this example, the values of the matrix 300 are characteristic of the type of paper to be printed on. The manner by which the matrix is derived is not particularly limited and may be obtained from calculations based on known material properties, or through the use of data collected via calibration samples. As noted, the values of the matrix 300 are highest at the corners of the matrix and along the edges. This corresponds to the regions of the paper where deformation caused by the application of ink may be the greatest and thus the most drying required.

Figure 6A:
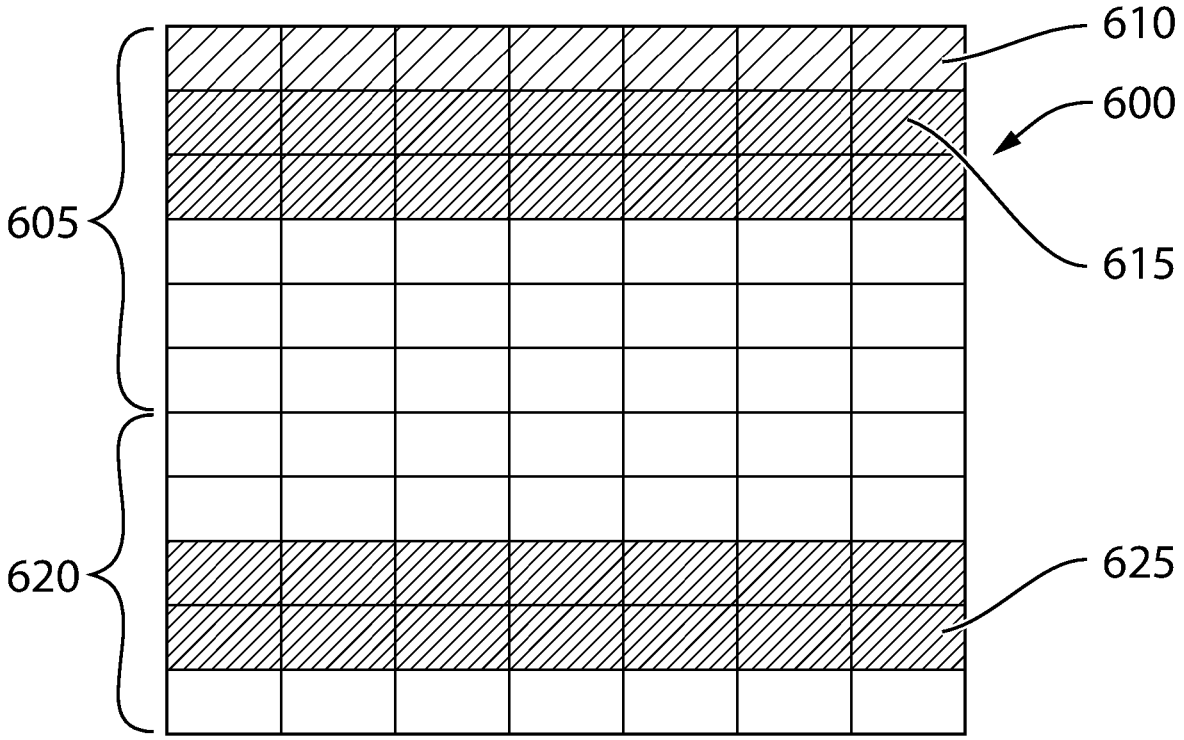
FIG. 6 is an example of (a) an image; and (b) a matrix of density values of the image.
Figure 6B:
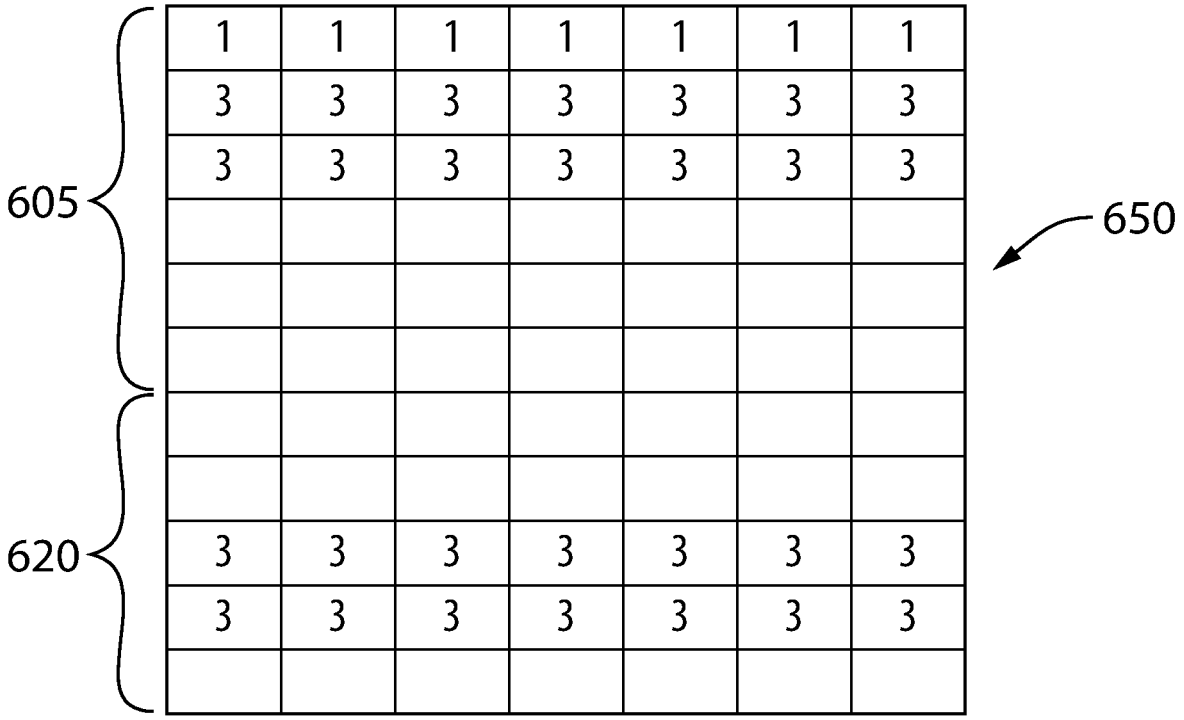

FIG. 6*a* shows an image 600 to be printed on the print system 50 or 50*a*. In this example, the image includes bands of different densities. In the leading edge 605 of the image, a light band 610 and a dark band 615 are provided. In the trailing edge 620, a single band 625 is provided with the same ink density as the band 615. FIG. 6*b* shows a matrix 650 of the ink density of the image 600.

Continuing with this example image shown in FIG. 6, the weighted matrix 300 may be applied to the matrix 650. In the present example, the score for each cell of the image 600 may be calculated by multiplying the value for the cell of the weighted matrix 300 by the ink density value in the matrix 650. In this example, the score for each cell is shown in FIG. 7 in matrix 680. The density score for the portions of the image may then be calculated by adding the values of each cell in the portion. In the example shown in matrix 680, the leading edge 605 has a score of 566 and the trailing edge 620 has a score of 408.

Assuming the mask reduces the score by 50 percent for the leading edge 605 and does not alter the score for the trailing edge 620, the density index for the leading edge 605 may be calculated to be 283 and the density index for the trailing edge may be 408. Accordingly, in this example, the leading edge now has a lower density index. Therefore, as the leading edge 605 enters the dryer 120 (i.e. before the trailing edge enters the dryer), the sheet of paper will move at a faster speed than when the trailing edge 620 also enters the dryer 120. Overall, the leading edge 605 may still spend more time in the dryer 120 than the trailing edge 620 since the sheet of paper stops at the position 220*b* and reverses direction prior to proceeding to position 220*c*. In this example, the leading edge 605 may enter the dryer 120 at a predetermined speed and slow down once the trailing edge 620 enters the dryer 120 at entry point 205. This provides more uniform drying across the sheet of paper to reduce over-drying of either the leading edge 605 or the trailing edge 620 relative to the other.

Although the present example is illustrated with the image 600 comprising bands, the application is not limited to such simple images and may be expanded to other more complicated images. Furthermore, the use of more cells (i.e. finer division of the image) may lead to more precise determination of the density scores and ultimately the density index. In addition, a sheet of paper may be divided into more than two portions in some examples. Additionally, the portions may also overlap with other portions.

The avoidance of over drying or under drying of the paper provides improved operation of the print system. In particular, the over drying or under drying of portions of the paper may lead to local deformation or curling of the paper. The reduction of over drying or under drying may improve the performance of the print system with the reduction of media jams and motor stalls. In addition, it may provide improved stacking of the media as well as reduced the size of the print system 50.

It should be recognized that features and aspects of the various examples provided above may be combined into further examples that also fall within the scope of the present disclosure.

What is claimed is:

1. A print system comprising:

a dryer to dry a sheet of paper;

a media feeder to feed the sheet of paper into the dryer;

a controller to vary a speed of the media feeder;

a communication interface to receive data associated with an image to print on the sheet of paper; and a processor coupled to the controller and the communication interface, wherein the processor is to determine a first density index for a first portion of the image and to determine a second density index for a second portion of the image, and wherein the processor is to adjust the speed of the media feeder via the controller based on the first density index, the second density index, and a time spent under influence of the dryer by a first portion of the sheet of paper that carries the first portion of the image.

2. The print system of claim 1, wherein the first portion is a leading edge and the second portion is a trailing edge, the leading edge to enter the dryer prior to the trailing edge.

3. The print system of claim 1, wherein the first density index and the second density index are determined via a weighted matrix, the weighted matrix having a plurality of cells configured to represent an expected deformation of the sheet of paper due to loading corresponding locations of the sheet of paper with print fluid.

4. The print system of claim 3, wherein the processor is to determine a score for a cell from the plurality of cells, the score based on an ink density and the weighted matrix, wherein the score is used to determine the first density index.

5. The print system of claim 1, comprising a duplexer to provide print on both sides of the sheet of paper, the duplexer to receive the sheet of paper from the dryer.

6. The print system of claim 5, wherein the dryer reverses a direction of the sheet of paper after a first side is dried to direct the sheet of paper to the duplexer.

7. The print system of claim 5, wherein the processor is to determine a correction factor for the first portion.

8. A non-transitory machine-readable storage medium encoded with instructions executable by a processor, the non-transitory machine-readable storage medium comprising:

instructions to receive data associated with an image to print on a sheet of paper;

instructions to print the image on the sheet of paper via a print head;

instructions to apply a mask to the image to separate the image into a first portion and a second portion, wherein the mask applies a correction factor;

instructions to determine a first density index associated with the first portion of the image;

instructions to determine a second density index associated with the second portion of the image; and instructions to adjust a speed of a media feeder via a controller based on the first density index, the second density index, and a time spent under influence of a dryer by a first portion of the sheet of paper that carries the first portion of the image, wherein the media feeder feeds the sheet of paper into the dryer.

9. The non-transitory machine-readable storage medium of claim 8, comprising instructions to determine the first density index and the second density index via a weighted matrix, the weighted matrix having a plurality of cells configured to represent an expected deformation of the sheet of paper due to loading corresponding locations of the sheet of paper with print fluid.

10. The non-transitory machine-readable storage medium of claim 9, comprising instructions to determine a score for a cell from the plurality of cells, the score based on an ink density and the weighted matrix, wherein the score is used to determine the first density index.

11. The non-transitory machine-readable storage medium of claim 10, comprising instructions to determine a correction factor for the first density index associated with the first portion.

12. A method comprising:

receiving data associated with an image to print on a sheet of paper;

spraying ink onto the sheet of paper to create the image;

applying a mask to the image, wherein the mask separates the image into a first portion and a second portion;

calculating a first density index associated with the first portion of the image via application of the mask;

calculating a second density index associated with the second portion of the image via application of the mask; and adjusting a speed of a media feeder via a controller based on the first density index, the second density index, and a time spent under influence of a dryer by a first portion of the sheet of paper that carries the first portion of the image, wherein the media feeder feeds the sheet of paper into the dryer.

13. The method of claim 12, wherein calculating the first density index and the second density index comprises using a weighted matrix, the weighted matrix having a plurality of cells configured to represent an expected deformation of the sheet of paper due to loading corresponding locations of the sheet of paper with print fluid.

14. The method of claim 13, comprising determining a score for a cell from the plurality of cells, the score based on an ink density and the weighted matrix, wherein the score is used to determine the first density index.

15. The method of claim 14, comprising determining a correction factor for the first density index associated with the first portion.

* * * * *